US006474512B2

(12) United States Patent
Wakayama

(10) Patent No.: US 6,474,512 B2
(45) **Date of Patent: *Nov. 5, 2002**

(54) LIQUID CONTAINER

(75) Inventor: Takahiro Wakayama, Ibaraki-ken (JP)

(73) Assignee: Riso Kagaku Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 12 days.

(21) Appl. No.: 09/757,532

(22) Filed: Jan. 11, 2001

(65) Prior Publication Data

US 2001/0009258 A1 Jul. 26, 2001

(30) Foreign Application Priority Data

Jan. 19, 2000 (JP) ..... 2000/010850

(51) Int. Cl.[7] ..... B65D 30/22
(52) U.S. Cl. ..... 222/386.5; 222/462
(58) Field of Search ..... 222/105, 462, 222/386.5

(56) References Cited

U.S. PATENT DOCUMENTS 4,961,518 A * 10/1990 Shoji et al. ..... 222/386.5
4,978,025 A * 12/1990 Fougeres ..... 222/105
5,188,261 A * 2/1993 Butters ..... 222/105
5,769,273 A * 6/1998 Sasaki et al. ..... 222/105
6,102,252 A * 8/2000 Overman et al. ..... 222/106
6,209,756 B1 * 4/2001 Van Der Heijden ..... 222/105

* cited by examiner

*Primary Examiner*—Philippe Derakshani
(74) *Attorney, Agent, or Firm*—Fitch, Even, Tabin & Flannery

(57) ABSTRACT

A liquid container is provided, which comprises a bag-forming flexible container body, a pouring outlet provided to communicate with an inside of the container body, and a support member provided in the container body for inhibiting deformation of the container body occurring near the pouring outlet when the contained liquid is sucked, in which the support members is a member reinforcing the container body with a form like a funnel narrowed at the pouring outlet. If the funnel-like reinforcing portion occupies almost one half of the surface area of the container proper, it can be prevented that the pouring outlet is closed even if the non-reinforced portion of the container body is housed in the support member when the contained liquid is discharged. Therefore, a contained liquid can be smoothly taken out, and the container is especially suitable for containing a liquid having a relatively high viscosity or a liquid sensitive to the contact with air and the like.

22 Claims, 7 Drawing Sheets

LIQUID CONTAINER

Figure 1:
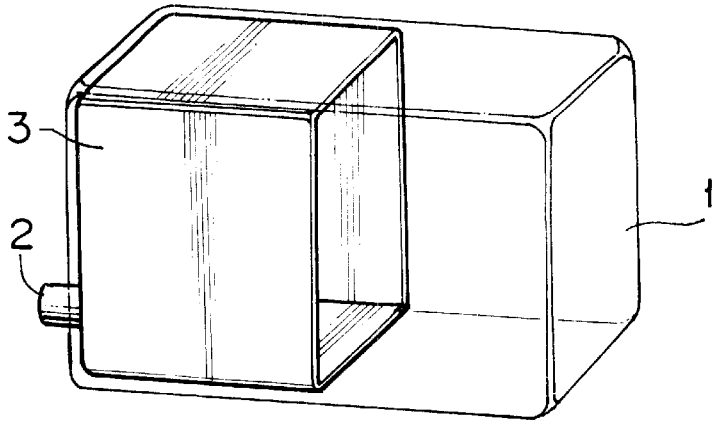

This invention relates to a flexible container suitable for containing a liquid, particularly, a liquid with a relatively high viscosity or a liquid sensitive to the contact with air.

Containers for packaging a liquid called bag-in boxes or bag-in cartons (hereinafter generally called "bag-in cartons") in which a flexible bag with a pouring outlet is contained in an outer box formed, for example, by a corrugated cardboard or a paperboard are well known. In general, they are formed by using a composite material consisting of, for example, a resin film and paper, and are often used for containing a liquid with a relatively low viscosity such as a beverage or liquid detergent. These containers having a bag each are handled in such a manner that when the contained liquid is taken out of the pouring outlet, air corresponding to the discharged liquid goes into the bag, or they are formed in such a manner that the bag is contracted to allow the contained liquid to be taken out.

A container forming a bag or a general bag-in carton allows almost all the quantity of the contained liquid to be easily taken out if the liquid has a relatively low viscosity like a beverage or liquid detergent, etc. However, if the contained liquid is a less flowable liquid with a high viscosity such as a printing ink, it can happen that while all the quantity of the contained liquid is discharged, the bag portion near the pouring outlet closes the pouring outlet or that the side faces of the bag adhere to each other at a position near the pouring outlet, thereby preventing the stable discharge of the liquid and causing a large quantity of the contained liquid to remain.

To solve the problem, for example, JP6-211273A proposes a bag-in carton having a bag stuck to the inner faces of the carton, in which only a region slightly larger than one half of the bag on the pouring outlet side is struck and fixed to the inner faces of the carton, and in which when the contained liquid is taken out the non-fixed portion of the bag moves toward the pouring outlet and fits in the portion fixed to the inner faces of the carton, so that almost all the quantity of the contained liquid can be taken out.

Furthermore, JP9-150500A proposes a container having a bag-forming container body, a pouring outlet connected to the container body, and an outer box covering the container body, wherein the pouring outlet of the container body is installed at the central bottom of the outer box, and the container body portion around the pouring outlet is bonded to the bottom of the outer box or a support member is provided for preventing the deformation of the container body portion around the pouring outlet, so that almost all the quantity of the contained liquid can be taken out.

Moreover, JP11-165747A proposes a container, in which a bag having a pouring outlet contains a tubular member for preventing the mutual adhesion of the inner faces of the bag when the liquid is sucked, to allow almost all the quantity of the contained liquid to be taken out.

However, the conventional containers having a bag each have respectively the following problems.

For example, the bag-in carton of JP6-211273A uses a composite material in which a bag generally formed by a resin film and a carton are stuck to each other. Because of this constitution, when the bag-in carton remaining after taking out the contained liquid is discarded as a waste, the carton and the bag relatively strongly adhering to each other must be troublesomely separated for discharge as sorted refuse.

In the container of JP9-150500A, the pouring outlet must be provided at the center of the bottom of the container body, and thus degree of freedom in the installation position of the pouring outlet is small. Furthermore, the entire container is required to have a symmetrical long form having two almost cubic forms disposed side by side on both sides of the pouring outlet. Moreover, for preventing that the pouring outlet is closed, a constitution for inducing the non-fixed bag portion to be folded into the bag portion fixed near the pouring outlet, for example, by a support member must be adopted respectively on both the side areas, which makes the entire structure complicated.

In the container of JP11-165747A, the bag used as the outer material of the container is formed, for example, with a flexible synthetic resin sheet, and it may have a pinhole or be broken due to falling, vibration, compression, etc., to leak the contained liquid during handling and transportation. If the film is thickened to have a sufficient bag breaking strength, the film is less likely to be housed inside the tubular member when the contained liquid is taken out, adversely affecting the liquid discharge performance or increasing the remaining quantity. Furthermore, if any information concerning the contained liquid such as a trade name and cautions is printed on the synthetic resin sheet, the information becomes difficult to read or unable to be read during use disadvantageously since the bag is deformed as the contained liquid is taken out. If the information is printed on the non-deformable portion of the synthetic resin sheet supported with the tubular member, a sufficient space for printing the information may not be able to be obtained.

The object of this invention is to solve the problems of these conventional flexible containers, by providing a flexible liquid container suitable for packaging a liquid with a high viscosity or a liquid sensitive to the contact with air.

According to this invention, the object of this invention can be achieved by a liquid container, which is composed of a bag-forming flexible container body, a pouring outlet provided to communicate with the inside of the container body, and a support member disposed in the container body for inhibiting the deformation of the container body occurring near the pouring outlet when the contained liquid is sucked, characterized in that the support member is a member reinforcing the container body with a form like a funnel narrowed at the pouring outlet.

In this invention, "a form like a funnel" generally means a form in which one end is widely opened while the other end is narrowed like a small hole, and is not limited to a form coaxial from one end to the other end as observed with experimental or cooking instruments, but can also be eccentric from one end to the other end as described in the following examples. Furthermore, it is not required that the support member per se is formed like a funnel, as far as the flexible bag is reinforced with a form like a funnel.

Thus, according to this invention, since the region near the pouring outlet of the container body is reinforced with a form like a funnel, the contained liquid is stably discharged, being guided by the portion reinforced with a form like a funnel, when taken out, and in addition, the non-reinforced portion of the container body can be smoothly housed into the portion reinforced with a form like a funnel conveniently. If the dimensions of the funnel-like reinforced portion are properly selected to suit the size of the bag, it can be prevented that when the contained liquid is taken out, the pouring outlet is closed with the portion of the container body housed in the reinforcing portion. Especially in the case where almost one half of the surface area of the bag is reinforced with the support member, even if the non-reinforced portion of the container body is housed in the reinforcing portion, it does not close the pouring outlet.

In this invention, the container body is not especially limited in form, but generally it is an elongated body which is cylindrical, quadrangular or polygonal, and it is convenient to form the pouring outlet at one of the closed end faces of the bag.

In the case where the container body is a bag formed like an almost quadrangular prism, it is preferable that the pouring outlet is formed at a closing end face of the bag, and that the support member holds the form of the end face and the forms of portions on the end face side of the four bag side faces adjacent to the end face, thereby reinforcing the container body with a form like a funnel. In this case, for example, the support member can be composed of hard sheet members extending along the end face of the bag and along portions on the end face side of the four bag side faces adjacent to the end face. Furthermore, the support member may also be composed of hard sheet members extending along the end face of the bag and along portions on the end face side of a pair of mutually opposing bag side faces adjacent to the end face.

Moreover, in the case where the container body is a bag formed like an almost quadrangular prism, the following constitution can be adopted; the pouring outlet is formed at a closed end face of the bag, and the support member is formed to support two faces, i.e., the end face of the bag and any one of bag side faces adjacent to the end face, while the pouring outlet is disposed adjacently to the angle formed by the two faces, thereby reinforcing the container body with a form like a funnel. In this case, the support member can be composed of hard sheet members extending along the two faces. Furthermore, the support member can also be composed of the above mentioned hard sheet members extending along the two faces and a pair of mutually opposing triangular sheet members which are respectively connected at two of the edges thereof with the former sheet members. Alternatively, the support member can be composed of a pair of triangular sheet members disposed along the a pair of mutually opposing bag side faces adjacent to both the two faces, and beam members connecting the pair of sheet members with each other.

The sheet members of the support member can be provided with openings, or can also be entirely or partially bonded to the container body.

The pouring outlet can be fixed to the support member or formed integrally with the support member. The container body can also be provided with an outer box for covering the body.

Figure 3:
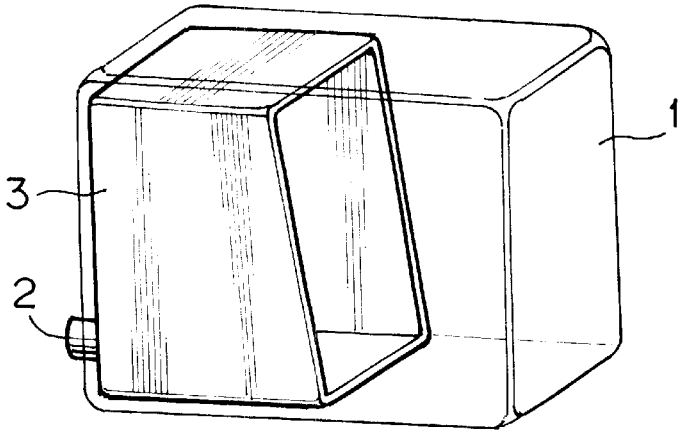
Figure 4:
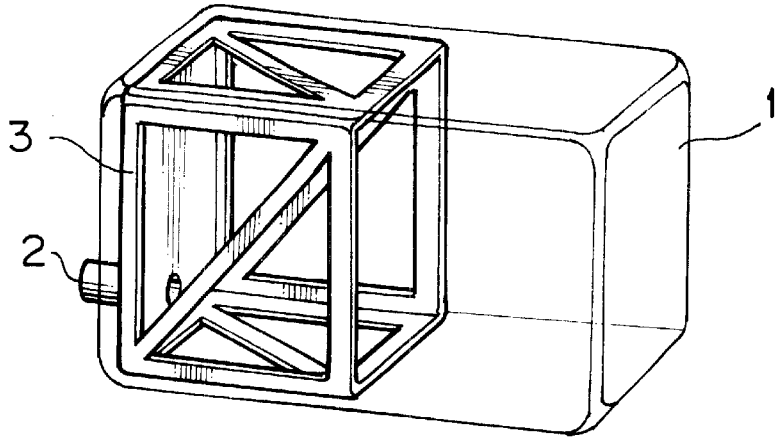
Figure 5:
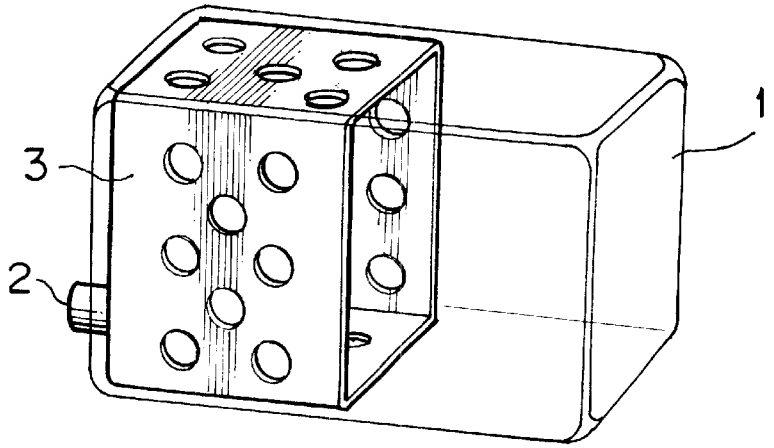
Figure 6:
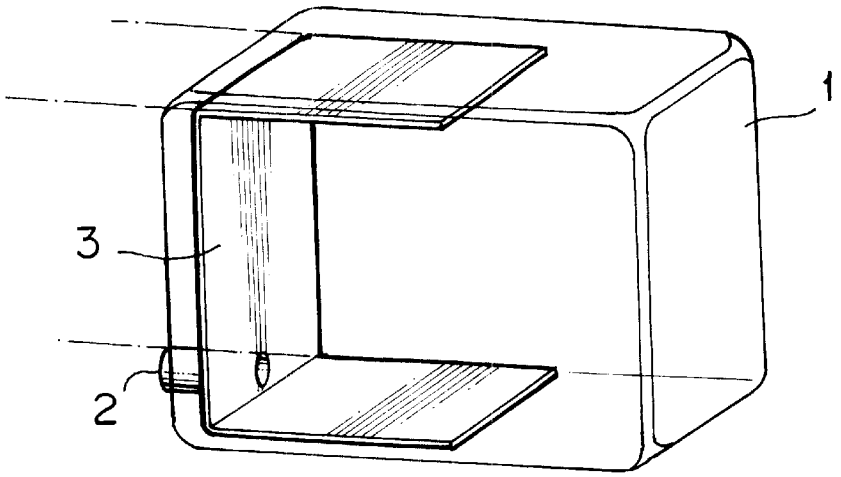
Figure 7:
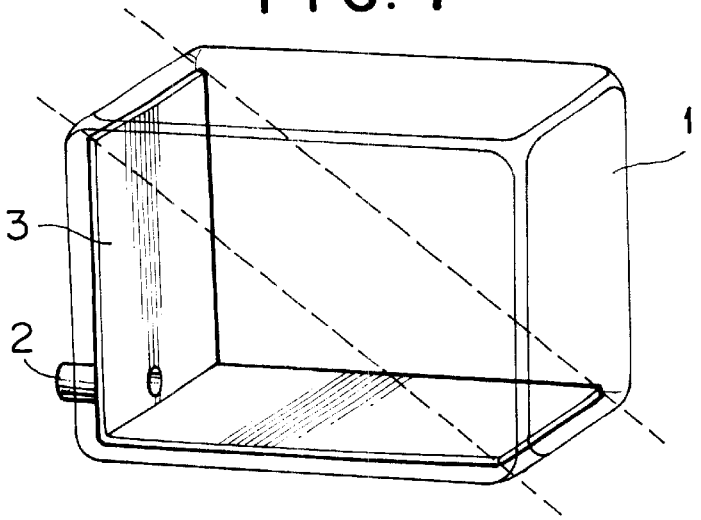
Figure 8:
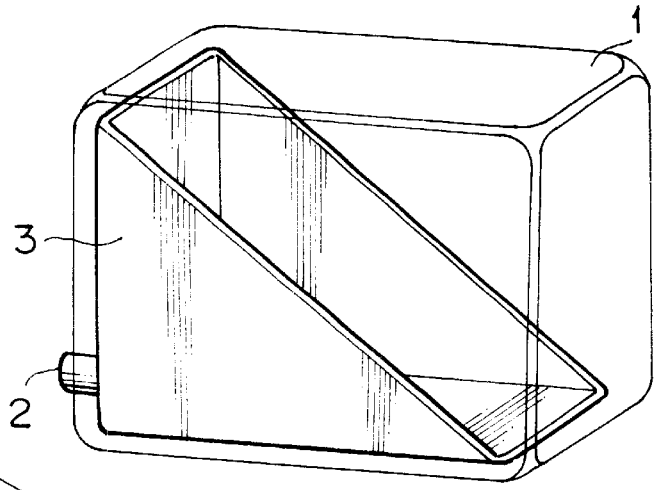
Figure 9:
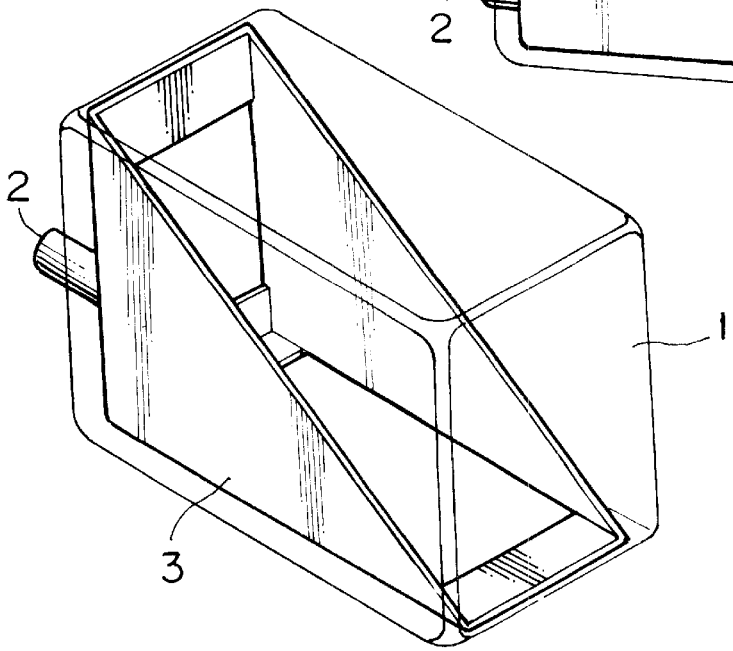
Figure 10:
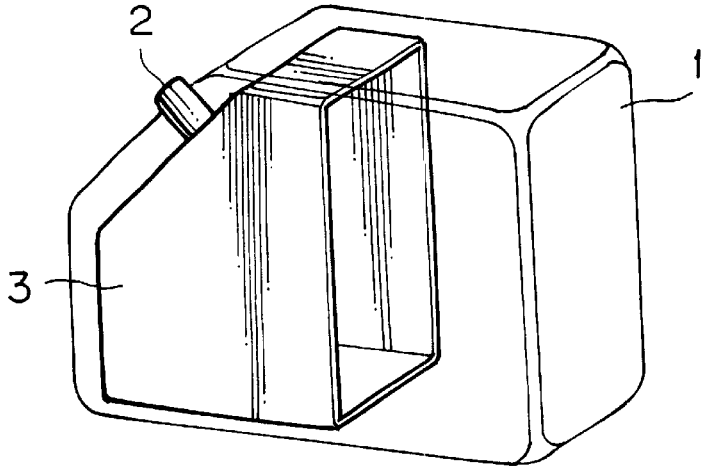
Figure 11:
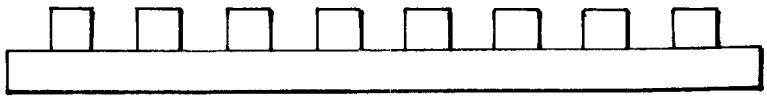
Figure 12:
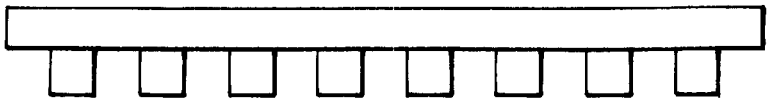
Figure 13:
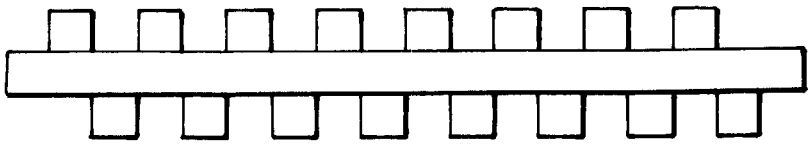
Figure 14:
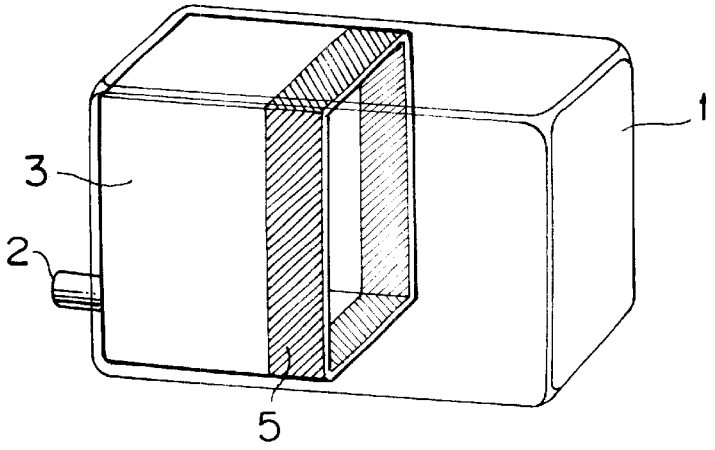
Figure 15:
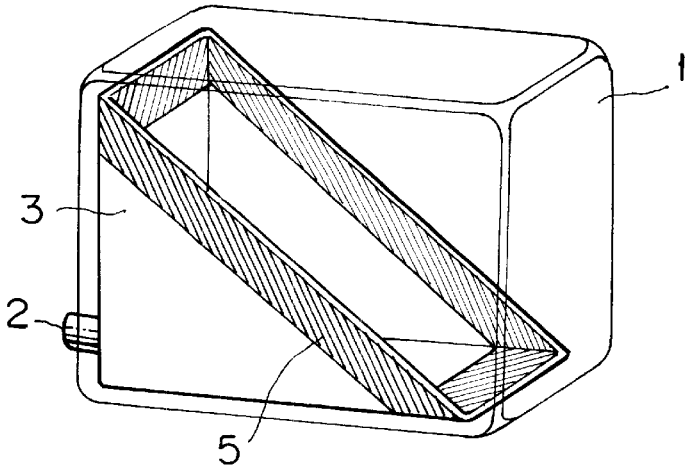
Figure 16:
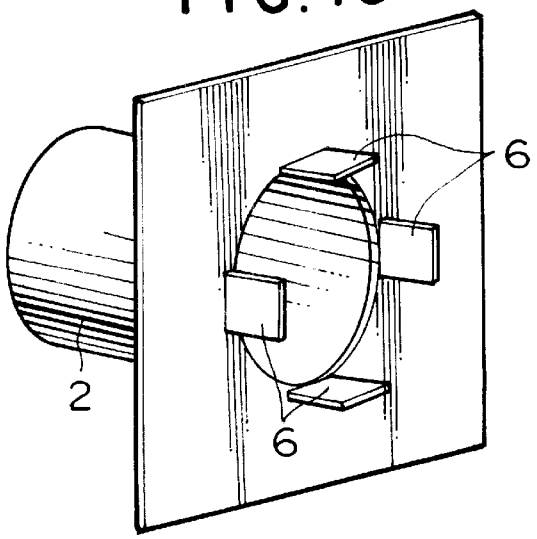
Figure 17:
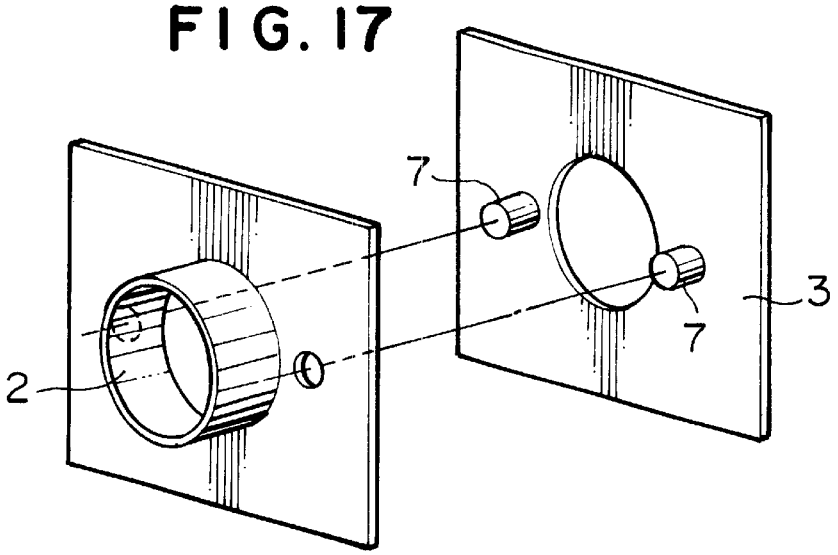
Figure 18:
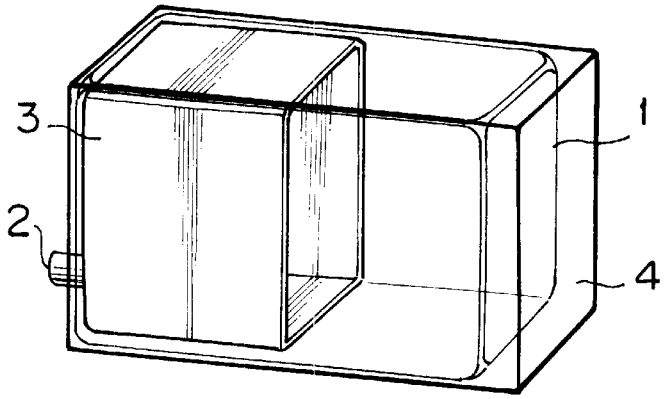
Figure 19:
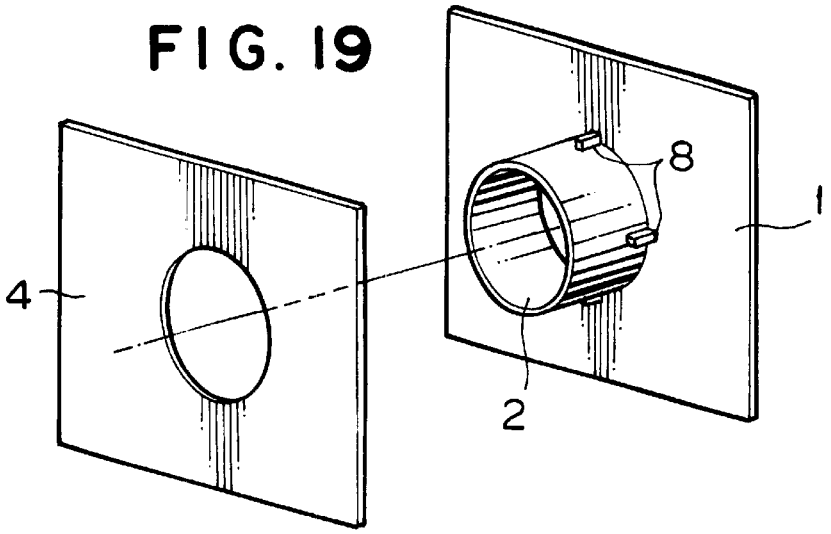
Figure 20:
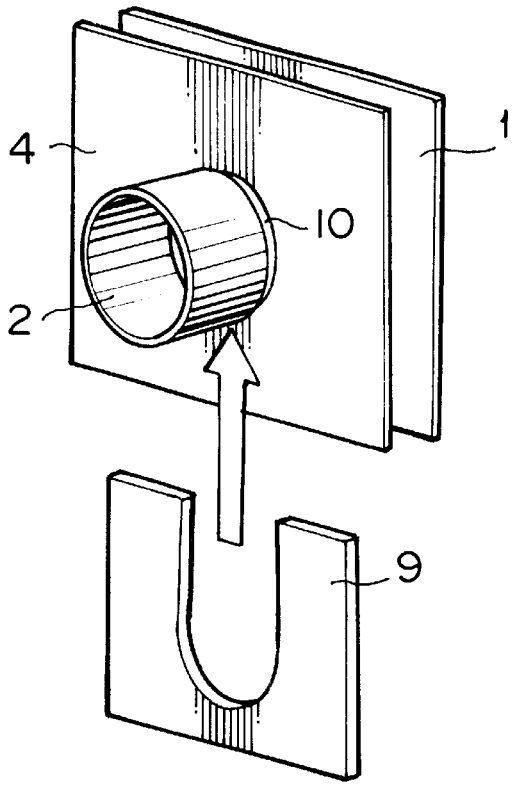
Figure 21:
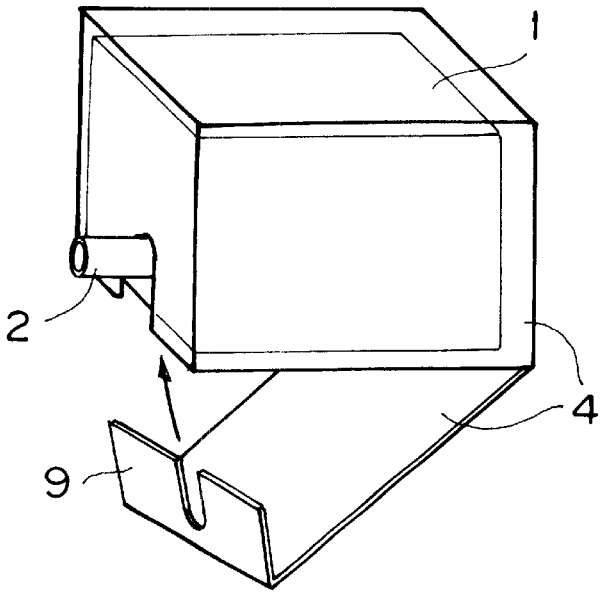

Examples of the liquid container of this invention are described below in reference to FIGS. 1 through 21. The examples shown in the drawings are illustrative, and this invention is not limited thereto or thereby. In the drawings, FIG. 1 is a schematic perspective view showing an example of the container of this invention, FIG. 2 is a side view showing the action of the container of FIG. 1, FIG. 3 is a schematic perspective view showing a modification example of FIG. 1, FIG. 4 is a schematic perspective view showing a modification example of FIG. 1, FIG. 5 is a schematic perspective view showing a modification example of FIG. 1, FIG. 6 is a schematic perspective view showing a modification example of FIG. 1, FIG. 7 is a schematic perspective view showing another example of the container of this invention, FIG. 8 is a schematic perspective view showing a modification example of FIG. 7, FIG. 9 is a schematic perspective view showing a modification example of FIG. 7, FIG. 10 is a schematic perspective view showing a further other example of the container of this invention, FIG. 11 is an end view showing an example of the form of the grooves provided in the support member, FIG. 12 is an end view showing another example of the form of the grooves provided in the support member, FIG. 13 is an end view showing a further other example of the form of the grooves provided in the support member, FIG. 14 is a schematic perspective view showing the bonding position between the support member and the container body in the example of FIG. 1, FIG. 15 is a schematic perspective view showing the bonding position between the support member and the container body in the example of FIG. 8, FIG. 16 is a perspective view showing a closing preventing means formed at the pouring outlet, FIG. 17 is an exploded perspective view showing a means for fixing the pouring outlet and the support member, FIG. 18 is a schematic perspective view showing a still further other example of the container of this invention, FIG. 19 is an exploded perspective view showing a means for fixing the pouring outlet and the outer box in the example of FIG. 18, FIG. 20 is an exploded perspective view showing another means for fixing the pouring outlet and the outer box in the example of FIG. 18, and FIG. 21 is a schematic perspective view showing the fixing means of FIG. 20.

The container of FIG. 1 has a container body 1 provided as a flexible bag formed by a plastic film. The container body 1 is made to form an almost quadrangular prism when filled with a liquid. The container body 1 is provided, at a lower portion of a closed end face, with a pouring outlet 2 formed to communicate with the inside of the container body 1 and to protrude outward from the container body 1. Furthermore, the container body 1 is provided internally with a support member 3 disposed adjacently to the end face provided with the pouring outlet 2. The support member 3 has a box form consisting of a rectangular hard end wall adjacent to the end face and side walls extending perpendicularly from the four sides of the end wall along the four side faces of the container body 1, and the pouring outlet 2 is provided through the end wall of the support member 3 and bonded to it, to keep the support member 3 in a predetermined position in the container body. The side walls of the support member 3 have a length corresponding to almost one half of the dimension of the container body in the longitudinal direction, to reinforce the former half of the container body 1 on the pouring outlet 2 side. Thus, the support member 3 is formed like a funnel by the end wall and the four side walls, having the pouring outlet 2 as a narrowed opening and the end surrounded by the side walls on the other side as an expanded opening. Therefore, the end face and side faces of the container body 1 adjacent to the support member 3 are reinforced with a form like a funnel, and can be prevented from being deformed when the contained liquid is taken out, particularly from being bent inward due to the internal pressure reduction.

Figure 2:
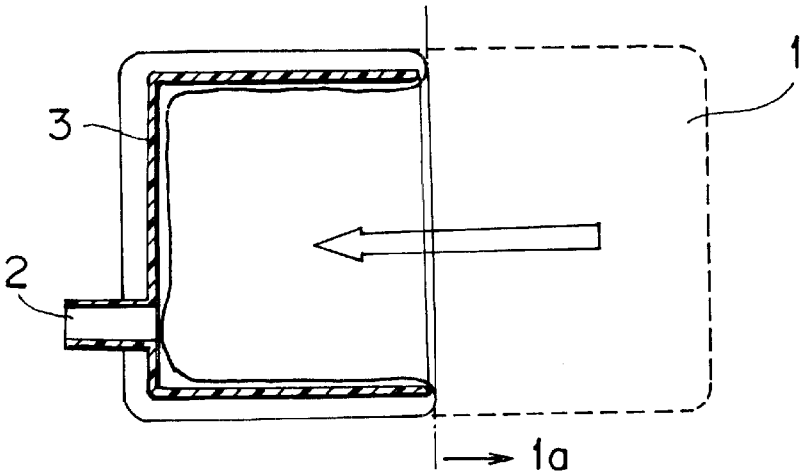

FIG. 2 is a typical view showing a state where the contained liquid has been taken out of the container of FIG. 1. As can be seen from FIG. 2, as the liquid is sucked by, for example, a pump, to be taken out of the pouring outlet 2, the liquid is discharged from the pouring outlet 2, being guided by the support member 3. Accordingly, with the liquid being taken out and the resultant pressure reduction in the container body, the latter half 1*a* of the container body 1 not supported by the support member 3 is displaced and reversed into the support member 3 sequentially as shown by an arrow in FIG. 2, and as illustrated, finally it is entirely housed in the support member 3. Also in this case, since the support member 3 extends up to the center in the longitudinal direction of the container body 1, it does not happen that the latter half 1*a* of the container body 1 reaches and closes the pouring outlet 2.

As described above, in this invention, it is only required that the support member 3 is located on the pouring outlet 2 side, and that the flexible container body 1 does not close the pouring outlet 2 before all the quantity of the contained liquid is taken out. For this purpose, it is only required that almost one half of the container body 1 on the pouring outlet 2 side, i.e., the former half has its form retained by the support member.

In this invention, the material of the bag-forming container body is only required to have flexibility sufficient to allow easy manual bending and sealing. Especially, a thin molded body of plastic or plastic resin film is preferable. Cellophane, polyethylene, polypropylene, polyester, nylon, polystyrene, polyvinyl chloride, polyvinylidene chloride, polyvinyl alcohol, polycarbonate, ethylene vinyl alcohol copolymer, fluorine resin, polymethyl methacrylate, polybutene, aluminum foil, any of said resins having a thin oxide film of Si or Al formed thereon, or any of said resins coated with polyvinylidene chloride, ethylene vinyl alcohol copolymer, wax and the like can be used in one layer or multi-layer. However, for the portion of the container body to have its form retained by the support member, since the form of the supported portion may be held by the strength of the container body per se, the portion is not required to be in a flexible state or to be made of a flexible material.

In this invention, the material of the support member can be any material as far as it can prevent the volumetric shrinkage for retaining the form when the pressure in the container body is reduced. For example, wood, plastic, metal or hard paper can be used. Considering the contained liquid and the disposal as a waste, a plastic material is preferable. This also applies to the material of the pouring outlet.

In this invention, it is desirable that the support member and the container body are firmly bonded to each other. The adhesives that can be used for bonding include various adhesives such as urea resins, melamine resins, phenol resins, epoxy resins, vinyl acetate resins, acrylic resins, cyanoacrylate adhesives, polyurethane adhesives and EVA. The adhesive type can be adequately selected from dry laminate type, water dry laminate type, non-solvent type, electron radiation curing type, ultraviolet curing type, hot melt type, etc. Especially when the container body and/or the support member is made of a plastic material, a bonding method without using any adhesive, such as ultrasonic method or heat seal method, can also be used.

FIG. 3 shows a modification example of FIG. 1. It is identical with the example of FIG. 1, except that the rear opening end of the support member 3 is rather inclined. Also in this case, the former half of the container body 1 on the pouring output 2 side is reinforced with a form like a funnel having the pouring outlet 2 as the narrowed opening. Therefore, as in FIG. 2, it does not happen that the pouring outlet 2 is closed when the contained liquid is taken out.

FIGS. 4 and 5 show other modification examples of FIG. 1. In the surfaces of the support member 3, openings are formed as desired. The support member of FIG. 4 is a framework with large openings, and the support member of FIG. 5 is composed of sheet members having many perforations. These openings can reduce the quantity of the material used for the support member 3. The form and size of the openings can be adequately selected to suit the strength of the support member 3 and the properties of the container body 1. Also in this case, as in FIG. 1, the former half of the container body 1 on the pouring outlet 2 side is reinforced with a form like a funnel having the pouring outlet 2 as the narrowed opening. Therefore, as in FIG. 2, it does not happen that the pouring outlet 2 is closed when the contained liquid is taken out.

FIG. 6 shows a further other modification example of FIG. 1. It is identical with the example of FIG. 1, except that the support member 3 is devoid of a pair of mutually opposing side walls. Also in this case, as in FIG. 1, the former half of the container body 1 on the pouring outlet 2 side is reinforced with a form like a funnel having the pouring outlet 2 as the narrowed opening. Therefore, as in FIG. 2, it does not happen that the pouring outlet 2 is closed when the contained liquid is taken out.

FIG. 7 shows another example of this invention. The container body 1 and the pouring outlet 2 of FIG. 7 are identical with those of FIG. 1, but the support member 3 is composed of sheet members extending along two faces, i.e., the bag end face provided with the pouring outlet 2 and a bag side face adjacent to the bag end face. Furthermore, the pouring outlet 2 is disposed adjacently to the angle between the two faces. As a result, the form of the two faces consisting of the end face and the side face along the support member 3 is retained, and in addition, as indicated by dotted lines of FIG. 7, also for the one pair of mutually opposing bag side faces adjacent to both the two faces, the form of almost one half demarcated by the diagonal lines (dotted lines in FIG. 7) on the pouring outlet 2 side is retained. Thus, since a funnel-like reinforced portion consisting of the almost one half is formed in the container body 1, it does not happen that the pouring outlet 2 is closed when the contained liquid is taken out.

FIG. 8 shows a modification example of FIG. 7. The support member 3 consists of hard sheet members extending along two faces, i.e., the bag end face provided with the pouring outlet 2 and a bag side face adjacent to it and a pair of mutually opposing right-angled triangular sheet members which are connected at two of the edges thereof to the above mentioned sheet members. Thus, since a funnel-like reinforced portion consisting of the almost one half similar to that of FIG. 7 is formed in the container body 1, it does not happen that the pouring outlet 2 is closed when the contained liquid is taken out.

FIG. 9 shows another mode for forming a funnel-like reinforced portion similar to those of FIGS. 7 and 8. In the example of FIG. 9, the support member 3 is formed by firmly connecting the mutually opposing vertexes of the pair of right-angled triangular sheet members of the support member 3 of FIG. 8, using three beam members. In this regard, it is different from the support member 3 of FIG. 8. Thus, similarly to FIGS. 7 and 8, since a funnel-like reinforced portion consisting of the almost one half is formed in the container body 1, it does not happen that the pouring outlet 2 is closed when the contained liquid is taken out.

FIG. 10 shows a further other example of this invention. The container body 1 is a heptahedral bag formed by truncating one ridge of a quadrangular prism as shown in FIG. 1, and the pouring outlet 2 is provided on the truncated face. In this regard, the example is different from that of FIG. 1. Thus, since a funnel-like reinforced portion occupying almost one half of the container body 1 is formed in the container body 1, it does not happen that the pouring outlet 2 is closed by the non-reinforced portion of the container body 1 when the contained liquid is taken out.

In the above examples, in order that the contained liquid can be smoothly guided toward the pouring outlet from the funnel-like reinforced portion, to be almost entirely taken out, it is desirable to form grooves toward the pouring outlet in some or all of the faces of the sheet members forming the support member 3. FIGS. 11 through 13 are sectional views showing examples of the grooves. As illustrated, the grooves can be provided on the inner surface and/or outer surface of each sheet member.

In the above examples, it is desirable that the support member 3 is entirely or partially bonded to the container body 1, and it is especially preferable that the support member 3 is bonded on the expanded opening side of the funnel-like reinforced portion. Particularly, in the example shown in FIG. 1 or 8, it is desirable that the periphery of the support member 3 on the expanded opening side, i.e., the bonding area 5 hatched in the drawing is sealingly bonded as shown in FIG. 14 or 15. The bonding allows the contained liquid to be prevented from going into the clearance between the support member 3 and the container body 1, and allows the residual quantity of the contained liquid to decrease after taking out the liquid.

As can be seen from the above examples, it is desirable that the pouring outlet 2 is installed at a position where the pouring outlet 2 is not closed by the non-reinforced portion of the container body 1 before all the quantity of the contained liquid is taken out. Particularly, as shown in the above examples, it is desirable to install it at a position farthest away from the non-reinforced portion of the container body. However, if a means for preventing the closing is provided at the pouring outlet 2, the pouring output 2 can be installed at any position of the container body 1 as long as the funnel-like reinforced portion of the container body is narrowed at the pouring outlet 2. In the example shown in FIG. 16, a few projections 6 apart from each other are formed at the circumference of the pouring outlet 2 toward the inside of the container body 1, to prevent that the pouring outlet 2 is closed by the non-reinforced portion of the container body folded into the support member 3 before almost all the quantity of the contained liquid is taken out.

In this invention, the pouring outlet 2 can be formed separately from the support member 3, but it is preferable that both are integrally formed or that the pouring outlet 2 prepared separately is firmly fixed to the support member 3 using an adequate means. FIG. 17 shows an example of a means 7 for fixing the pouring outlet 2 to the support member 3. In the fixing means of FIG. 17, the pouring outlet 2 is formed in the container body 1, and an opening communicating to the pouring outlet 2 is formed in the support member 3. Furthermore, a pair of pins 7 protruding outward from the container are provided around the opening, and are inserted through a pair of holes formed near the pouring outlet 2 of the container body 1, for bonding using an adhesive or heat seal, etc. As another method, with the pouring outlet 2 integrally formed with the support member 3, the pouring outlet 2 is inserted into a hole formed in the container body 1, and the hole and the pouring outlet 2 are bonded to each other.

The container of this invention can also be housed in an outer box for covering it, as shown in FIG. 18. The outer box 4 can improve the beautiful appearance and the effect of protecting the container body and the contained liquid from the vibration and impact acting during transportation. It also allows the information concerning the contained liquid to be relatively easily indicated. In the case where the container shown in FIG. 18 is connected to a device for sucking the contained liquid such as a pump, radial projections 8 can be provided around the pouring outlet 2 as shown in FIG. 19, to ensure the connection with such a device, so that the pouring outlet 2 may be engaged with the hole of the outer box 4, when the pouring outlet 2 is inserted through the hole. Furthermore as shown in FIG. 20, a neck 10 can be provided in the pouring outlet 2, so that after the pouring outlet 2 is inserted through the hole of the outer box 4, a fixing member 9 having a curved portion to be engaged with the neck can be engaged with the neck 10, for fixing to the outer box 4. The fixing member 9 can also be formed at the edge of an openable cover of the outer box 4 as shown in FIG. 21.

According to this invention, a support member is disposed inside a container body formed as a flexible bag, to form a funnel-like reinforced portion having a pouring outlet as a narrowed opening. Therefore, the contained liquid can be smoothly discharged from the pouring outlet. Furthermore, in the case where the funnel-like reinforced portion occupies almost one half of the surface area of the container body, even if the non-reinforced portion of the container body is reversed to be housed in the reinforced portion as the contained liquid is taken out, it is prevented that the pouring outlet is closed by the non-reinforced portion. Thus, even if the contained liquid has a relatively high viscosity, almost all the quantity can be taken out.

What is claimed is:

1. A liquid container which comprises a bag forming a flexible container body, wherein said container body is adapted to form an almost quadrangular prism which has an end face and bag side faces; a pouring outlet formed at said end face of the bag; and a support member that is contained in the container body and capable of reinforcing almost one half of the surface area of the bag to keep the form of said end face and the form of portions of said bag side faces that are adjacent to the end face, whereby the container body is reinforced in a form approximately funnel shaped.

2. A liquid container according to claim 1, wherein said support member is composed of hard sheet members extending along the end face of the bag and along the portions on the end face side of the four bag side faces adjacent to the end face.

3. A liquid container according to claim 1, wherein said support member is composed of hard sheet members extending along the end face of the bag and along portions on the end face side of a pair of mutually opposing bag side faces adjacent to the end face.

4. A liquid container according to claim 2 or 3, wherein said sheet members have openings.

5. A liquid container according to claim 2 or 3, wherein said sheet members have grooves extending toward the pouring outlet for guiding the contained liquid toward the pouring outlet.

6. A liquid container according to any one of claims 2 or 3, wherein said sheet members are bonded to the container body at least partially.

7. A liquid container according to claim 6, wherein said sheet members are bonded to the container body at their edges on the side in opposite to the pouring outlet.

8. A liquid container which comprises a bag forming a flexible container body, a pouring outlet provided to communicate with an inside of the container body, and a support member contained in the container body for inhibiting deformation of the container body from occurring near the pouring outlet when a contained liquid is sucked through said pouring outlet, in which said support member reinforces the container body with a form like a funnel narrowed at the pouring outlet, wherein said container body forms a bag in an almost quadrangular prism shape, said bag having an end face; said pouring outlet being on at said end face; said support member is configured such that the end face and any one of the bag side faces adjacent to the end face are kept free from said pouring outlet; and said pouring outlet is disposed adjacently to the angle formed by the end face and said bag face.

9. A liquid container according to claim 8, wherein said support member consists of hard sheet members extending along the two faces.

10. A liquid container according to claim 8, wherein said support member consists of hard sheet members extending along the two faces, and a pair of mutually opposing triangular sheet members connected at two sides thereof with those sheet members.

11. A liquid container according to claim 8, wherein said support member consists of a pair of right-angled triangular sheet members disposed along a pair of mutually opposing bag side faces adjacent to both the two faces, and beam members connecting the pair of sheet members each other.

12. A liquid container according to any one of claims 9 through 11, wherein said sheet members have openings.

13. A liquid container according to any one of claims 9 through 11, wherein said sheet members have grooves extending toward the pouring outlet for guiding the contained liquid to the pouring outlet.

14. A liquid container accordingly to any one of claims 9 through 11, wherein said sheet members are at least partially bonded to the container body.

15. A liquid container according to claim 14, wherein said sheet members are bonded to the container body along the edges on the side opposite to the pouring outlet.

16. A liquid container which comprises a bag forming a flexible container body that defines an interior volume, a pouring outlet provided to communicate with said interior volume of the container body, and a support member contained in the interior volume for inhibiting deformation of the container body from occurring near the pouring outlet when a liquid within said container body is removed through said pouring outlet, in which said support member reinforces at least part of the container body in an approximate funnel shape that is narrowed at the pouring outlet and is adapted to receive the non-reinforced portion of said container body as when the liquid contained within said container is removed through said pouring outlet.

17. A liquid container according to claim 16, wherein said support member reinforces almost one half of the surface area of the bag.

18. A liquid container according to claim 16, wherein said pouring outlet has a means for preventing the container body contracted with discharge of the contained liquid from closing the pouring outlet.

19. A liquid container according to claim 16, wherein said pouring outlet is fixed to the support member or is integrally formed with the support member.

20. A liquid container according to claim 16, wherein said container body is provided with an outer box for covering the container body.

21. A liquid container according to claim 18, wherein said preventing means comprises spaced apart projections about a circumference of the pouring outlet in communication with the interior of the container body.

22. A liquid container according to claim 16, wherein said container body is a hepahedral bag.

* * * * *